US007869735B2

(12) United States Patent
Hattori

(10) Patent No.: US 7,869,735 B2
(45) Date of Patent: Jan. 11, 2011

(54) IMAGE FORMING APPARATUS HAVING PAPER DUST COLLECTING ROLLER

(75) Inventor: Yoshiteru Hattori, Ichinomiya (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 1085 days.

(21) Appl. No.: 11/561,504

(22) Filed: Nov. 20, 2006

(65) Prior Publication Data

US 2007/0147875 A1 Jun. 28, 2007

(30) Foreign Application Priority Data

Dec. 26, 2005 (JP) ..... 2005-372011

(51) Int. Cl.
*G03G 21/00* (2006.01)

(52) U.S. Cl. ..... 399/98

(58) Field of Classification Search ..... 399/98
See application file for complete search history.

(56) References Cited

U.S. PATENT DOCUMENTS

| | | | | |
|---|---|---|---|---|
| 4,919,047 | A * | 4/1990 | Inouye et al. | 101/175 |
| 6,219,505 | B1 | 4/2001 | Sato et al. | |
| 6,415,119 | B2 | 7/2002 | Nishimura et al. | |
| 6,505,019 | B2 | 1/2003 | Sato et al. | |
| 6,708,009 | B2 * | 3/2004 | Fuwazaki et al. | 399/98 |
| 6,785,485 | B2 * | 8/2004 | Kamimura | 399/71 |
| 6,871,030 | B2 * | 3/2005 | Nishimura | 399/98 |
| 7,149,455 | B2 * | 12/2006 | Hattori | 399/98 |
| 7,162,184 | B2 * | 1/2007 | Tsusaka | 399/124 |
| 7,496,317 | B2 | 2/2009 | Igarashi et al. | |
| 7,522,872 | B2 * | 4/2009 | Fukuta | 399/390 |
| 2001/0026705 | A1 | 10/2001 | Sato et al. | |
| 2002/0098013 | A1 * | 7/2002 | Kamimura | 399/167 |
| 2003/0049043 | A1 * | 3/2003 | Fuwazaki et al. | 399/98 |
| 2003/0175042 | A1 * | 9/2003 | Nishimura | 399/98 |
| 2004/0265001 | A1 * | 12/2004 | Tsusaka | 399/124 |
| 2005/0019073 | A1 * | 1/2005 | Hattori | 399/388 |
| 2006/0188306 | A1 * | 8/2006 | Fukuta | 399/390 |
| 2010/0052244 | A1 * | 3/2010 | Terao | 271/109 |
| 2010/0129108 | A1 * | 5/2010 | Hayakawa et al. | 399/98 |

FOREIGN PATENT DOCUMENTS

JP H59-133566 A 7/1984

(Continued)

OTHER PUBLICATIONS

Japan Patent Office; Office Action in Japanese Patent Application No. 2005-372011 (counterpart to the above-captioned U.S. patent application) mailed Aug. 25, 2009.

*Primary Examiner*—David M Gray
*Assistant Examiner*—Geoffrey T Evans
(74) *Attorney, Agent, or Firm*—Baker Botts L.L.P.

(57) ABSTRACT

An image forming apparatus includes a main casing, a paper-dust collecting roller, a paper-dust removing member, a conveying roller, and an urging member. The paper-dust collecting roller is rotatably supported at a fixed position in the main casing so as to confront a conveying path of a recording medium. The paper-dust collecting roller is configured to collect paper dusts adhering to the recording medium. The paper-dust removing member removes the paper dusts collected by the paper-dust collecting roller. The conveying roller is supported at a position in confrontation with the paper-dust collecting roller across the conveying path. The conveying roller is configured to remove relative to the paper-dust collecting roller. The urging member urges the conveying roller toward the paper-dust collecting roller.

8 Claims, 14 Drawing Sheets

FOREIGN PATENT DOCUMENTS

| | | | |
|---|---|---|---|
| JP | H04-129940 | A | 4/1992 |
| JP | 2003081477 | | 3/2003 |
| JP | 2003267578 | | 9/2003 |
| JP | 2005-015184 | A | 1/2005 |
| JP | 2005-255284 | A | 9/2005 |

* cited by examiner

IMAGE FORMING APPARATUS HAVING PAPER DUST COLLECTING ROLLER

CROSS REFERENCE TO RELATED APPLICATIONS

This application claims priority from Japanese Patent Application No. 2005-372011 filed Dec. 26, 2005. The entire content of the priority application is incorporated herein by reference.

TECHNICAL FIELD

The disclosure relates to an image forming apparatus.

BACKGROUND

In image forming apparatuses such as laser printers, sheets (recording mediums) are separated from each other and fed one by one while being sandwiching between a sheet feeding roller and a sheet feeding pad. Consequently, paper dusts (paper powders) are generated on the sheet due to rubbing between the sheet and the sheet feeding pad. When such paper dusts are mixed into toner or adhered to a formed image, quality of the image is lowered.

Thus, a paper dust collecting roller charged with static electricity is provided at a position in confrontation with a conveying roller provided on a sheet conveying path, as disclosed in U.S. Pat. Nos. 6,219,505, 6,415,119, 6,505,019, and 6,708,009 and U.S. Patent Application Publication No. 2001/026705 (these are related to Japanese Patent Application Publication No. 2003-81477). At rotation of the paper dust collecting roller, the paper dusts generated on the sheet are collected by the paper dust collecting roller. In addition, the paper dusts collected by the paper dust collecting roller are scraped off by a scraping member (paper dust removing member) which is disposed in contact with the paper dust collecting roller and formed of a sponge or the like. Then, the paper dusts scraped by the scraping member are conveyed by a paper dust conveying unit and stored in a paper dust storing unit.

SUMMARY

The conveying roller for conveying a sheet on the conveying path by rotating due to a rotational driving force transmitted from a motor is generally fixed to a main casing to transmit the rotational driving force properly. On the other hand, in comparison to the conveying roller, the paper dust collecting roller in confrontation with the conveying roller does not require such high accuracy in transmission of the driving force. For this reason, the paper dust collecting roller is not fixed to the main casing so as to let sheets of various thicknesses through and to be movable relative to the conveying roller.

Thus, for example, when the scraping member for removing the paper dusts is fixed, there is a possibility that the paper dusts cannot be sufficiently scraped off the paper dust collecting roller. Therefore, the scraping member is also provided with a mechanism for moving in connection with movement of the paper dust collecting roller.

However, when the scraping member is provided with the mechanism for moving in connection with movement of the paper dust collecting roller, the image forming apparatus becomes complicated in configuration and large in size.

Further, the paper dusts conveyed by the paper dust conveying unit and stored in the paper dust storing unit tend to concentrate at a certain place in the paper dust storing unit. Thus, paper dust storage space in the paper dust storing unit cannot be sufficiently utilized.

In view of the foregoing, it is an object of the invention to provide an image forming apparatus having a simplified configuration. Another object of the invention is to provide an image forming apparatus that prevents paper dusts from being stored only at a certain place to utilize a paper dust storage space.

In order to attain the above and other objects, according to one aspect, the invention provides an image forming apparatus. The image forming apparatus includes a main casing, a paper-dust collecting roller, a paper-dust removing member, a conveying roller, and an urging member. The paper-dust collecting roller is rotatably supported at a fixed position in the main casing so as to confront a conveying path of a recording medium. The paper-dust collecting roller is configured to collect paper dusts adhering to the recording medium. The paper-dust removing member removes the paper dusts collected by the paper-dust collecting roller. The conveying roller is supported at a position in confrontation with the paper-dust collecting roller across the conveying path. The conveying roller is configured to move relative to the paper-dust collecting roller. The urging member urges the conveying roller toward the paper-dust collecting roller.

According to another aspect, the invention also provides an image forming apparatus. The image forming apparatus includes a main casing, a paper-dust collecting roller, a paper-dust removing member, a paper-dust conveying unit, and a paper-dust storing unit. The main casing has a cover that is configured to open and close. The paper-dust collecting roller is disposed at a position along a conveying path of a recording medium. The paper-dust collecting roller is configured to collect paper dusts adhering to the recording medium. The paper-dust removing member removes the paper dusts collected by the paper-dust collecting roller. The paper-dust conveying unit conveys the paper dusts removed by the paper-dust removing member. The paper-dust storing unit stores the paper dusts conveyed by the paper-dust conveying unit. The paper-dust storing unit is provided at the cover.

BRIEF DESCRIPTION OF THE DRAWINGS

Illustrative aspects in accordance with the invention will be described in detail with reference to the following figures wherein.

DETAILED DESCRIPTION

<Illustrative Aspects>

1. Overall Configuration of Laser Printer

Figure 1:
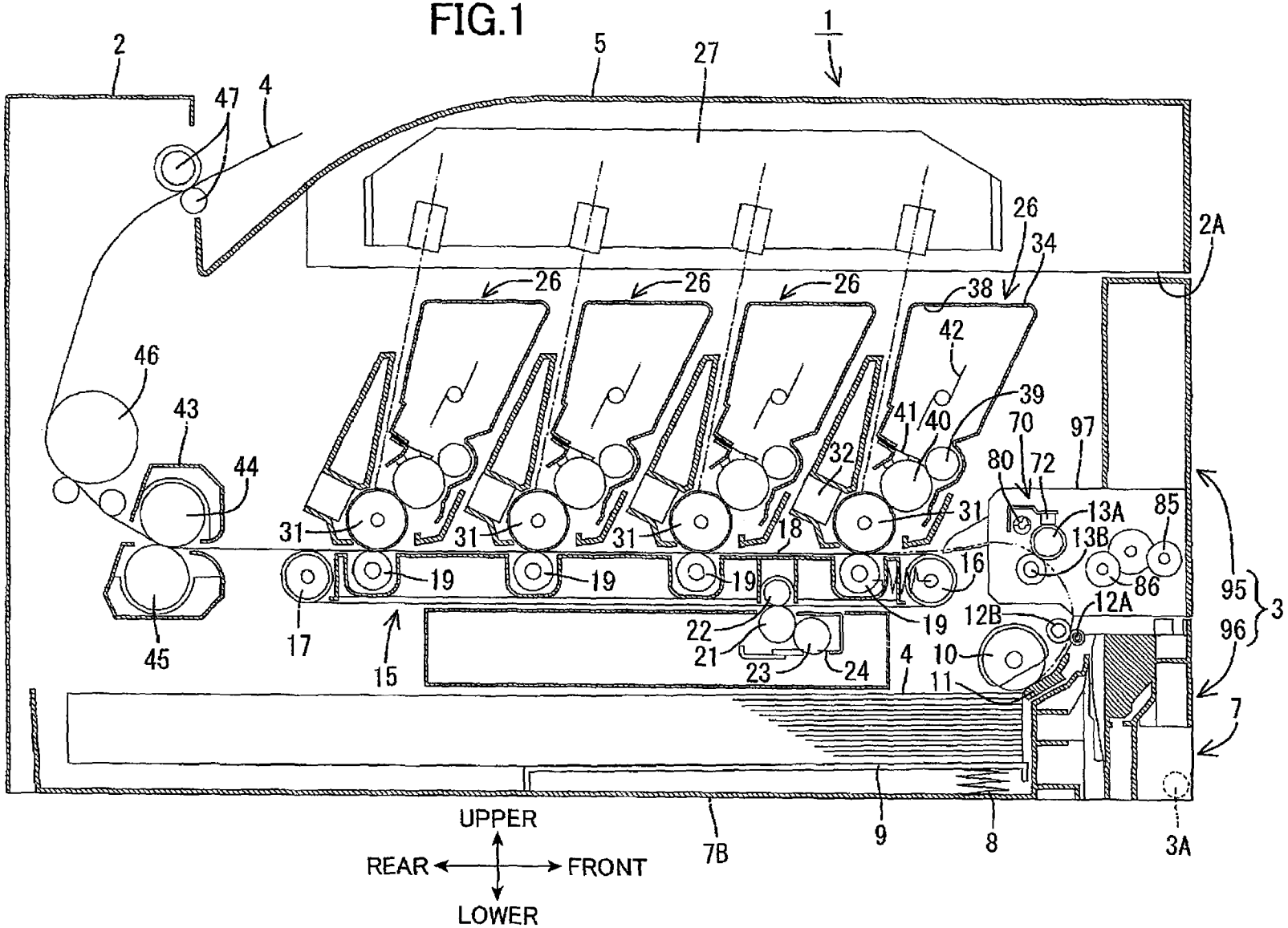
FIG. 1 is a side cross-sectional view showing schematic configuration of a laser printer according to illustrative aspects of the invention.

An image forming apparatus according to illustrative aspects of the invention will be described while referring to FIGS. 1 through 14.

In the following description, the expressions "front", "rear", "upper", "lower", "right", and "left" are used to define the various parts when the image forming apparatus is disposed in an orientation in which it is intended to be used. The right side in FIG. 1 is defined as the front of the image forming apparatus.

A laser printer 1 according to the illustrative aspects is a direct transfer tandem-type color laser printer. As shown in FIG. 1, the laser printer 1 has a substantially box-like main casing 2. An openable front cover 3 is provided on the front surface of the main casing 2. As shown in FIG. 2, by opening the front cover 3 frontward by pivotally moving about a pivoting shaft 3A provided at the lower end of the front cover 3, the process cartridges 26 and a belt unit 15 in the main casing can be replaced (mounted/dismounted) and paper jam generated in the main casing 2 can be eliminated (refer to FIG. 4). Specific configuration of the front cover 3 will be described later in detail.

Figure 2:
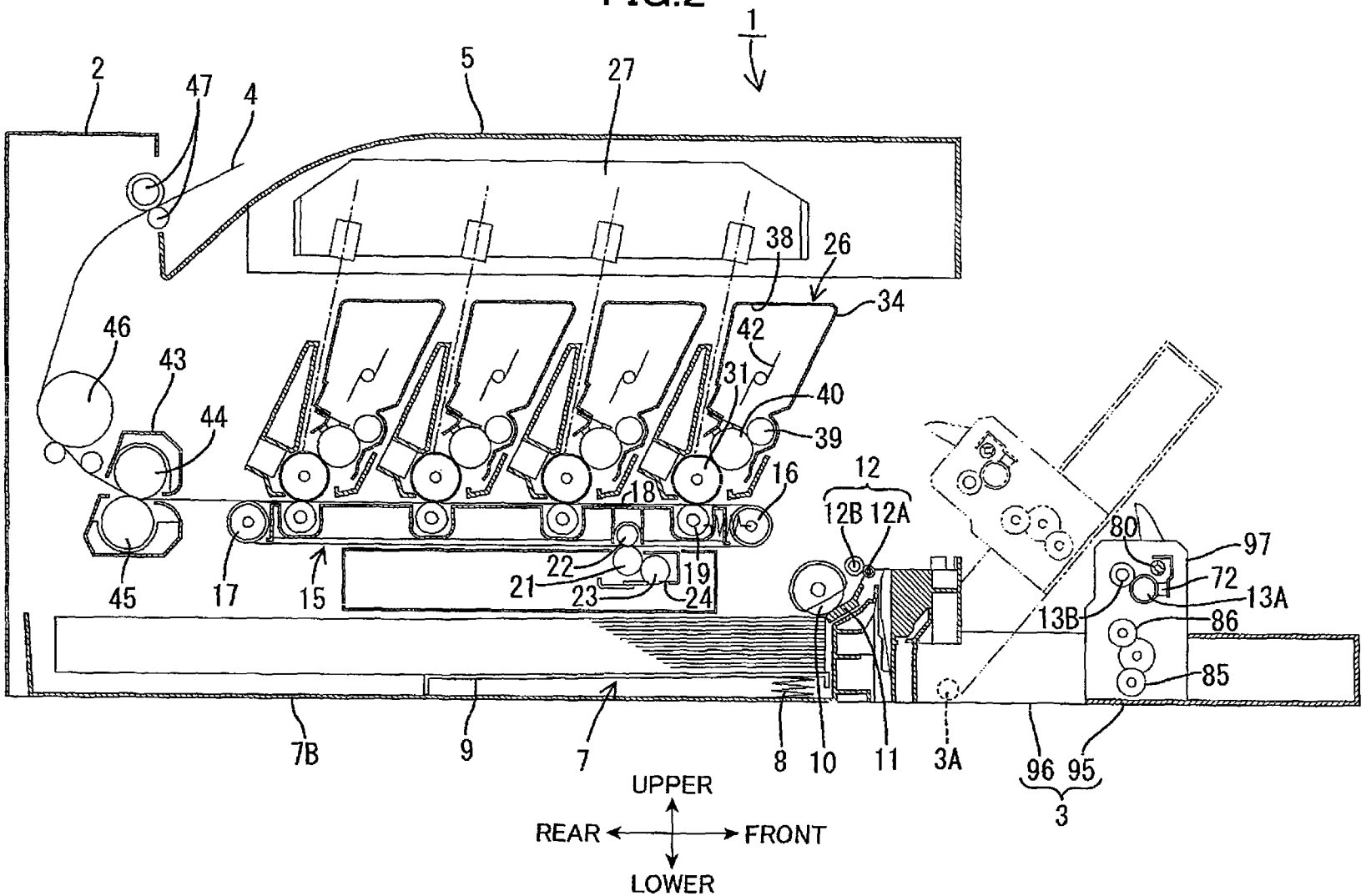
FIG. 2 is a side cross-sectional view showing schematic configuration of the laser printer in a state where a front cover of the laser printer is opened.

As shown in FIG. 1, a sheet discharge tray 5 for discharging the sheet on which an image is formed is provided on the upper surface of the main casing 2.

A sheet feeding cassette 7 for accommodating the sheet 4 on which an image is to be formed is mounted in the bottom of the main casing 2 so as to be pulled out frontward (inserted/removed).

The sheet feeding cassette 7 has a box shape which is opened upward. A pivotally-movable sheet pressing plate 9 is provided on a sheet accommodating part 7B in the sheet feeding cassette 7 so as to lift the front end of the sheet 4 by bias of a spring 8. A pickup roller 10 and a separating pad 11 which is pressed against the pickup roller 10 by bias of a spring (not shown) are provided above the front end of the sheet accommodating part 7B. A pair of sheet feeding rollers 12 (12A, 12B) are provided obliquely to the upper front of the pickup roller 10. Above the sheet feeding rollers 12A, a paper dust collecting roller 13A for collecting paper dusts (paper powders) adhered to the sheet 4 and a conveying roller 13B for conveying the sheet 4 sent from the sheet feeding roller 12, which will be described later, are provided so as to confront each other. The sheet 4 is conveyed on the conveying path while being sandwiched between the paper dust collecting roller 13A and the conveying roller 13B.

As shown in FIG. 1, the uppermost sheet 4 in the sheet feeding cassette 7 is pushed toward the pickup roller 10 by the sheet pressing plate 9. The sheets are separated from each other and fed one sheet at a time by rotation of the pickup roller 10 when being sandwiched between the pickup roller 10 and the separating pad 11. The sheet 4 sent from between the pickup roller 10 and the separating pad 11 is sent toward the paper dust collecting roller 13A and the cit conveying roller 13B (the downstream side in the conveying path).

A scanner unit 27, the four process cartridges 26, and belt unit 15 are provided in the main casing 2.

The four process cartridges 26 are disposed below the scanner unit 27. The process cartridges 26 corresponding to colors of magenta, yellow, cyan and black, respectively, are detachably arranged in the front-to-rear direction.

Each of the process cartridges 26 has a photosensitive drum 31, a scorotron charger 32, and a detachable developing cartridge 34.

The developing cartridge 34 has a substantially box-like shape. A toner accommodating chamber 38 is provided in the upper portion of the developing cartridge 34. A feeding roller 39, a developing roller 40 and a thickness regulating blade 41 are provided below the toner accommodating chamber 38. Each toner accommodating chamber 38 is provided with an agitator 42 for agitating toner.

A fixing unit 43 has a heating roller 44 and a pressing roller 45.

The belt unit 15 is provided below the process cartridges 26. The belt unit 15 has a pair of supporting rollers 16 and 17 which are disposed separately from each other in the front-to-rear direction and a conveying belt 18 horizontally stretching between the supporting rollers 16 and 17. The belt unit 15 can be mounted in or removed from the main casing 2.

Four transfer rollers 19 disposed in confrontation with the photosensitive drums 31 of the below-described process cartridges are arranged on the inner side of the conveying belt 18 at regular intervals in the front-to-rear direction.

A cleaning roller 21 for removing the toner and paper dusts which are adhered to the conveying belt 18 is provided under the belt unit 15. The cleaning roller 21 is in confrontation with a metal backup roller 22 provided on the belt unit 15 across the conveying belt 18. The cleaning roller 21 is in contact with a metal collecting roller 23 for removing the toner and the like adhered to the surface of the cleaning roller 21. The collecting roller 23 is in contact with a blade 24 for scraping off the toner and the like adhered to the surface of the collecting roller 23.

2. Configuration of Front Cover

As shown in FIG. 1, the front cover 3 is configured of a cover main body 95 closing an opening 2A of the main casing 2 and a cover connecting part 96 connecting the lower end of the cover main body 95 to the pivoting shaft 3A of the main casing 2 (refer to FIG. 2).

The sheet feed unit 97 is provided on the cover main body 95 at a position close to the cover connecting part 96 (the lower portion of the cover main body 95 in FIG. 1) so as to protrude rearward from the cover main body 95. The sheet feed unit 97 conveys the sheet 4 to the belt unit 15.

As shown in FIG. 1, the sheet feed unit 97 has the conveying roller 13B, the paper dust collecting roller 13A (pinch roller), a paper dust removing part 70, and an auger member 80. The conveying roller 13B guides the sheet 4 to the conveying path toward the belt unit 15. The paper dust collecting roller 13A is disposed in confrontation with the conveying roller 13B and collects paper dusts adhered to the conveyed sheet 4 (sandwiched between the paper dust collecting roller 13A and the conveying roller 13B). The paper dust removing part 70 removes the paper dusts collected by the paper dust collecting roller 13A. The auger member 80 conveys the paper dusts removed by the paper dust removing part 70 to a paper dust storing chamber 90.

In the illustrative aspects, the paper dust collecting roller 13A is rotatably supported at a fixed position, while the conveying roller 13B is rotatably supported so as to be movable with respect to the paper dust collecting roller 13A (movable in a direction toward and away from the paper dust collecting roller 13A).

<Configuration for Moving Conveying Roller>

Figure 3:
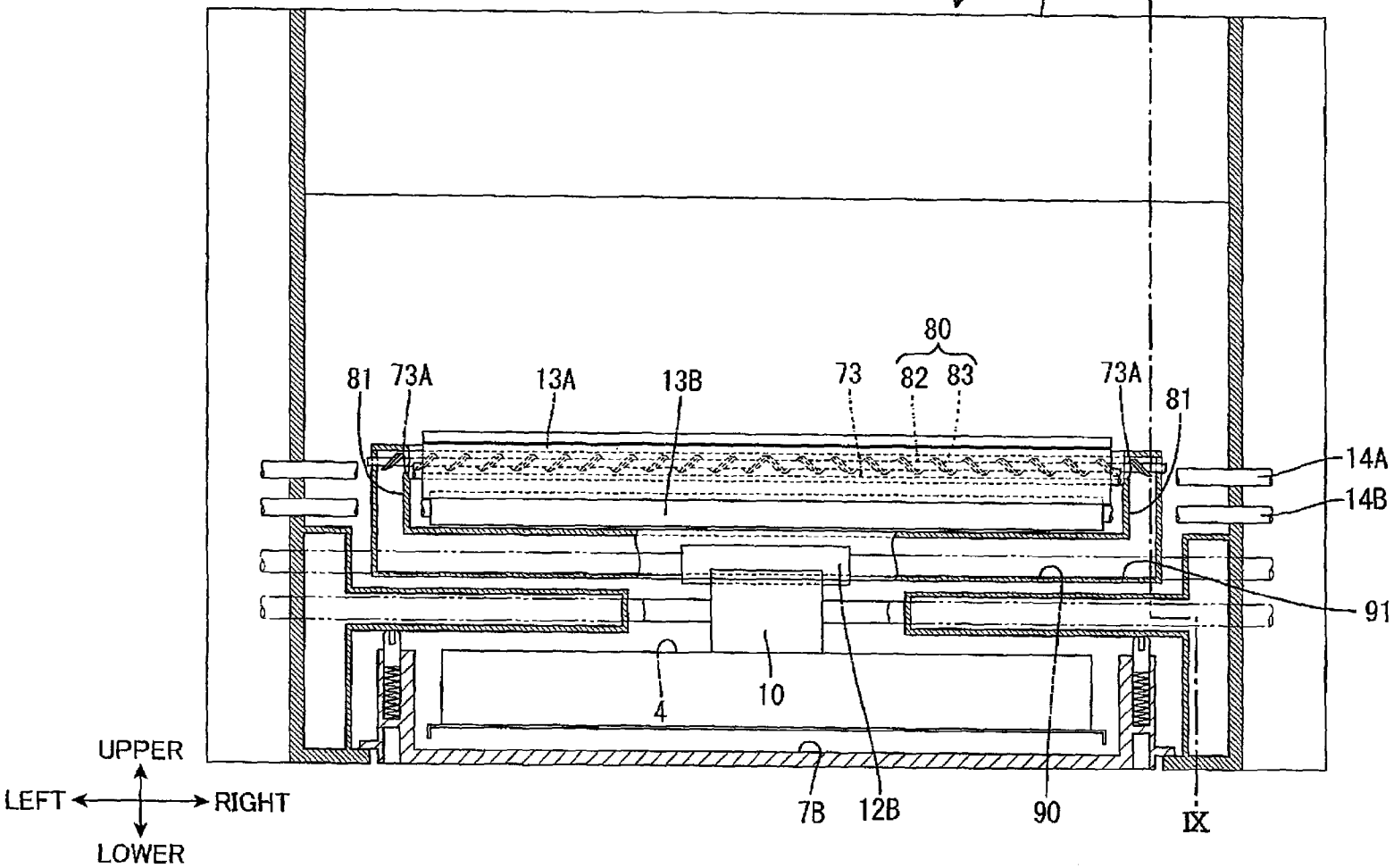
FIG. 3 is a vertical cross-sectional view of the laser printer.
Figure 4:
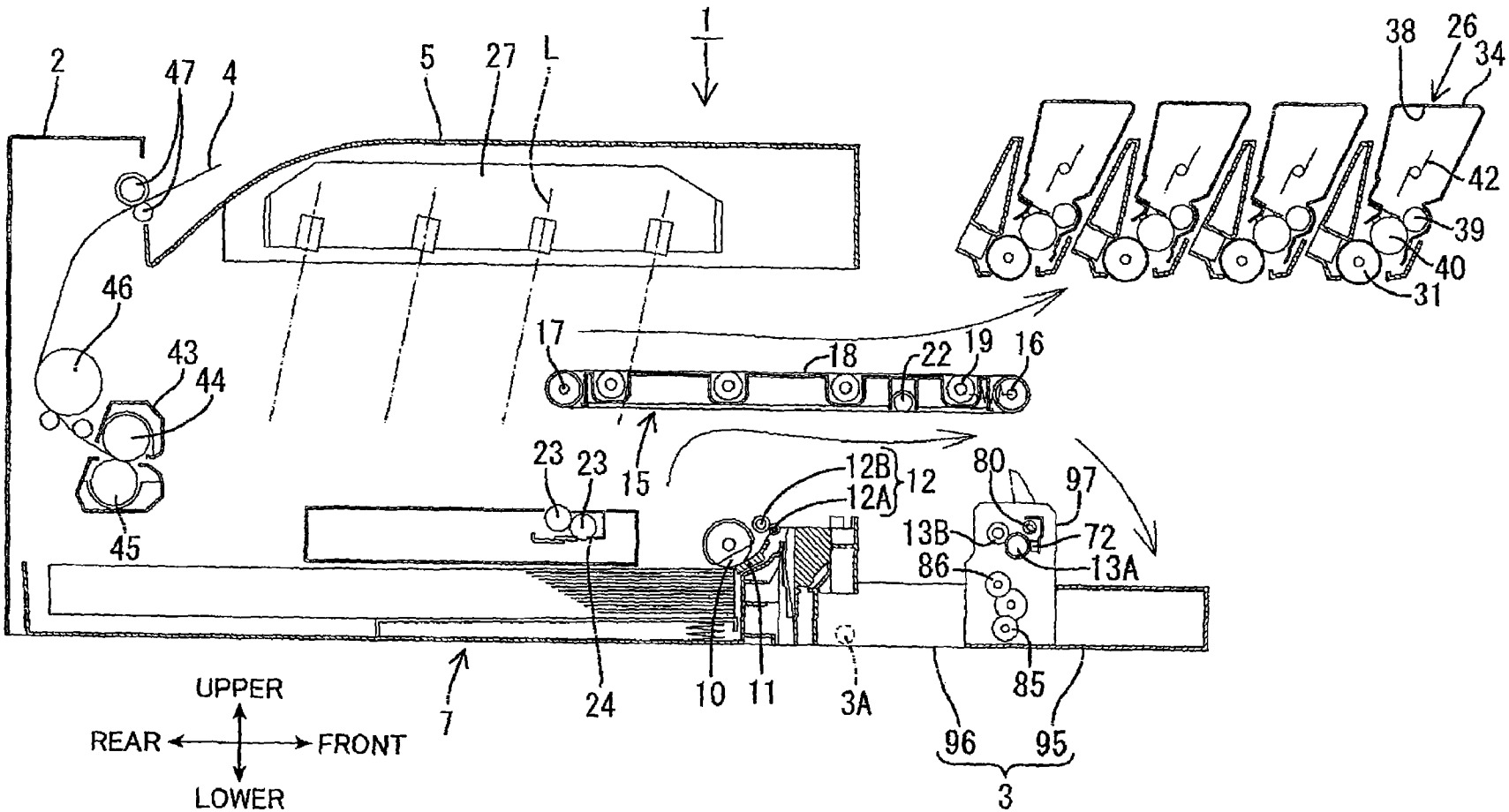
FIG. 4 is a side cross-sectional view showing a state where process cartridges are being replaced.
Figure 5:
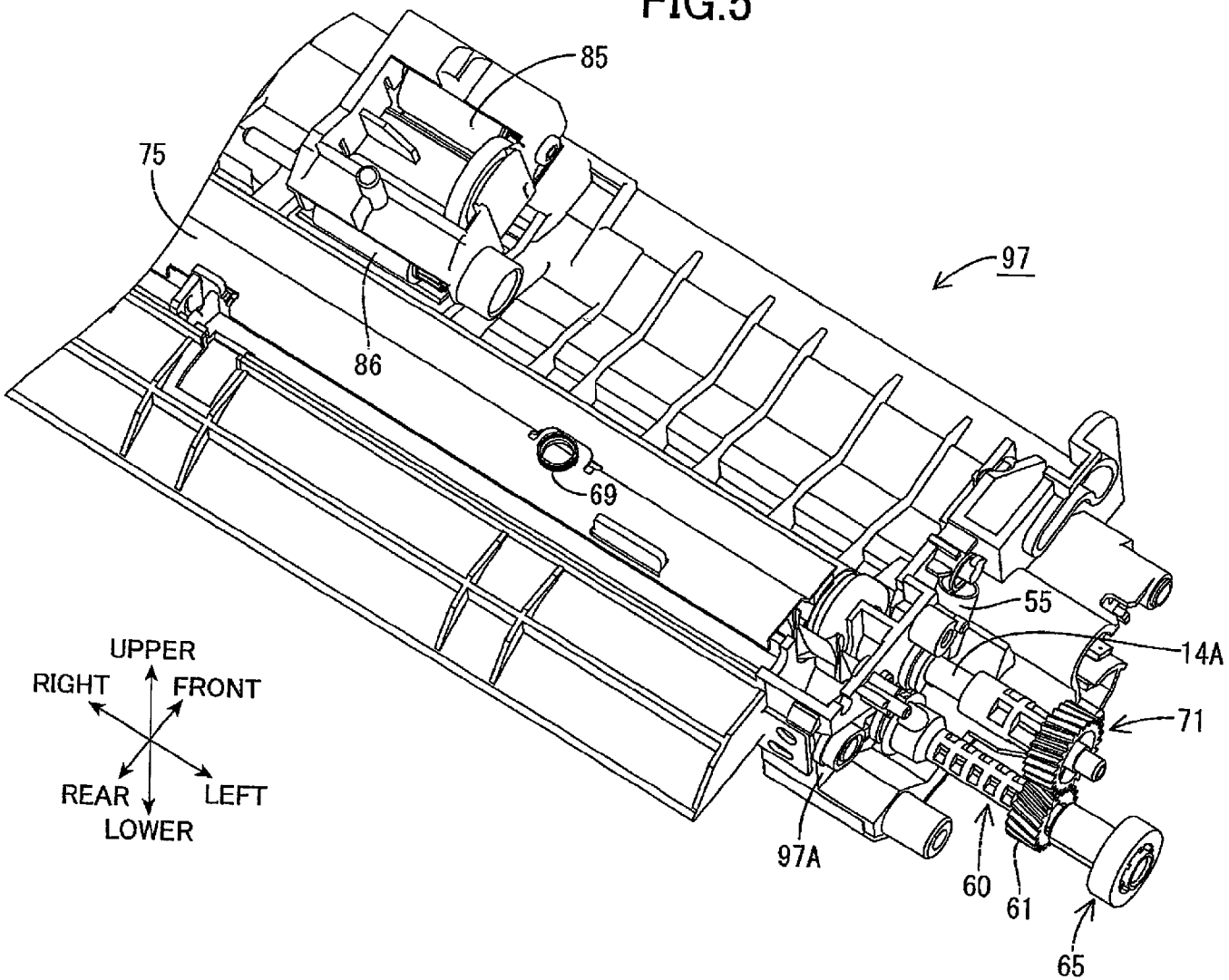
FIG. 5 is a perspective view of a sheet feed unit provided at the front cover when viewed from obliquely above.
Figure 6:
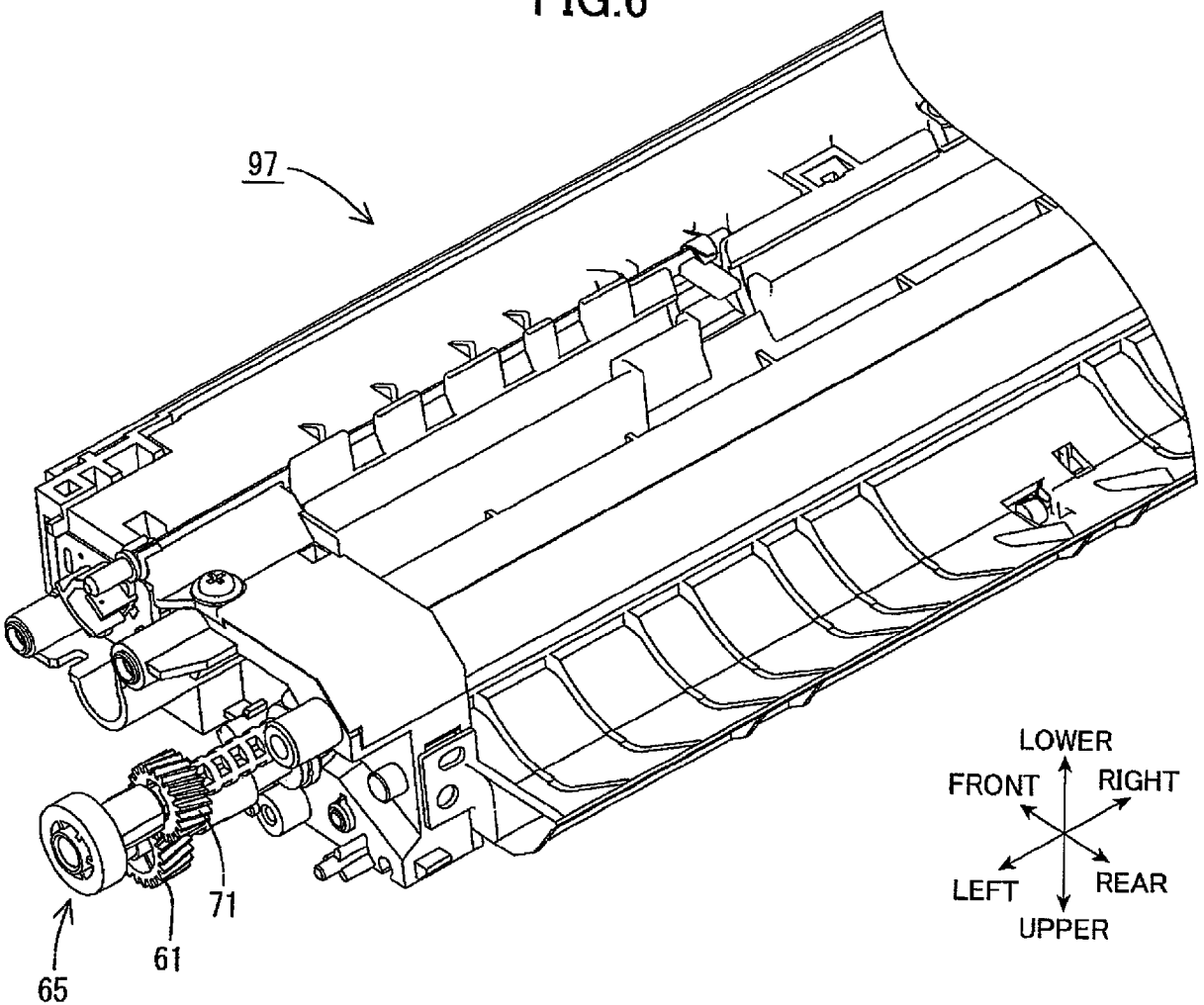
FIG. 6 is a perspective view when viewed from obliquely below (the opposite side to the side in FIG. 5)

The paper dust collecting roller 13A has a metal roller shaft 14A (FIG. 3). The roller shaft 14A is rotatably supported by a bearing on a side wall 97A (FIG. 5) of the sheet feed unit 97 at a fixed position. That is, the roller shaft 14A is rotatably supported at a fixed position in the main casing 2. As shown in FIG. 5, a follow gear 71 is connected to the roller shaft 14A. The follow gear 71 engages with a drive gear 61 of a joint 60 described later, thereby rotating the paper dust collecting roller 13A.

Figure 7:
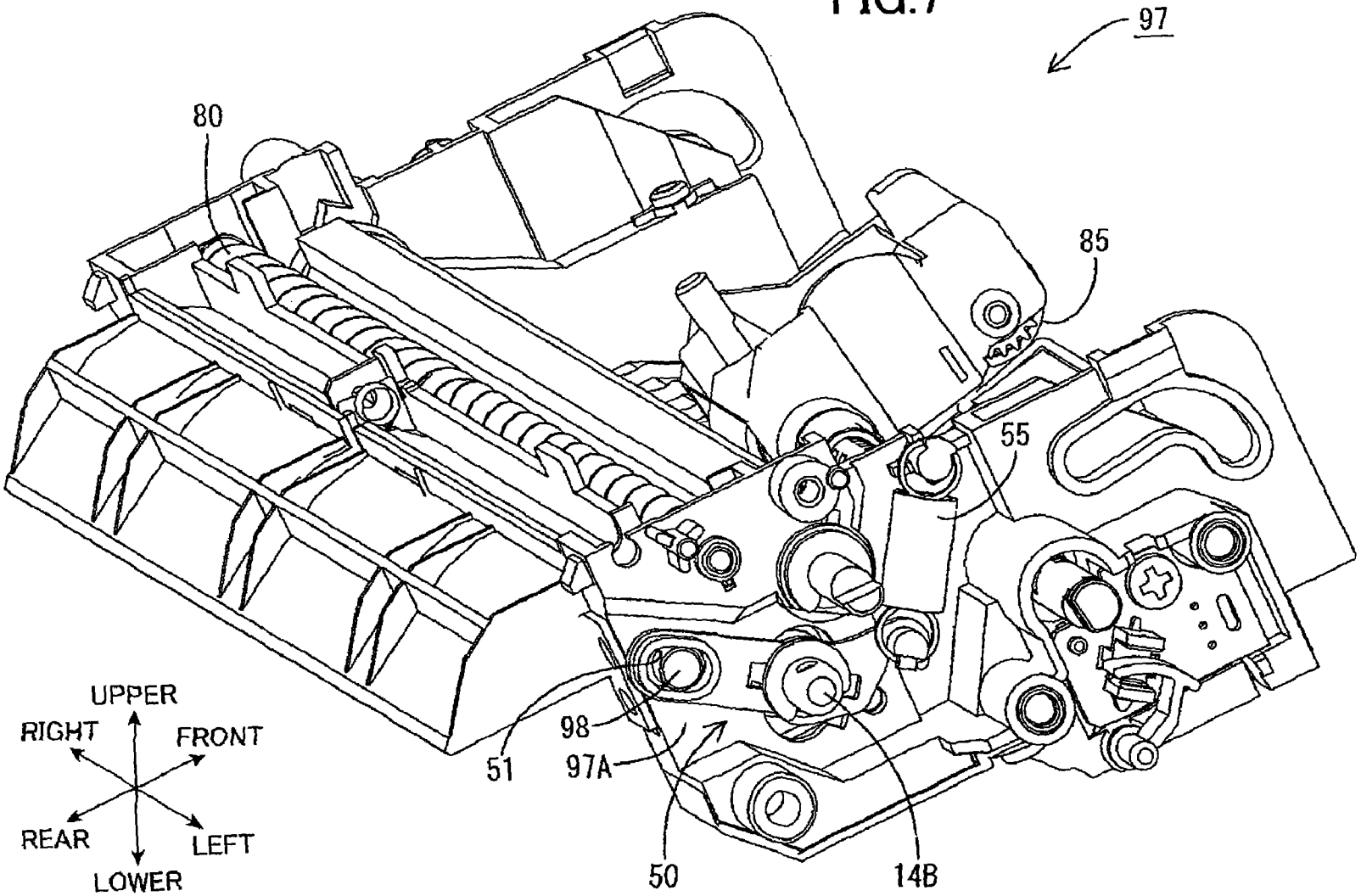
FIG. 7 is a perspective view showing a state where structure containing a gear coupled to the sheet feed unit is detached.

The conveying roller 13B is formed by covering a metal roller shaft 14B having a circular cross section with an elastic member made of rubber or a similar material. As shown in FIG. 7, the roller shaft 14B is received by a bearing member 50 which enables moving of the conveying roller 13B (the roller shaft 14B of the conveying roller 13B) relative to the paper dust collecting roller 13A. That is, the conveying roller 13B is rotatably supported so as to be movable relative to the paper dust collecting roller 13A.

Figure 14:
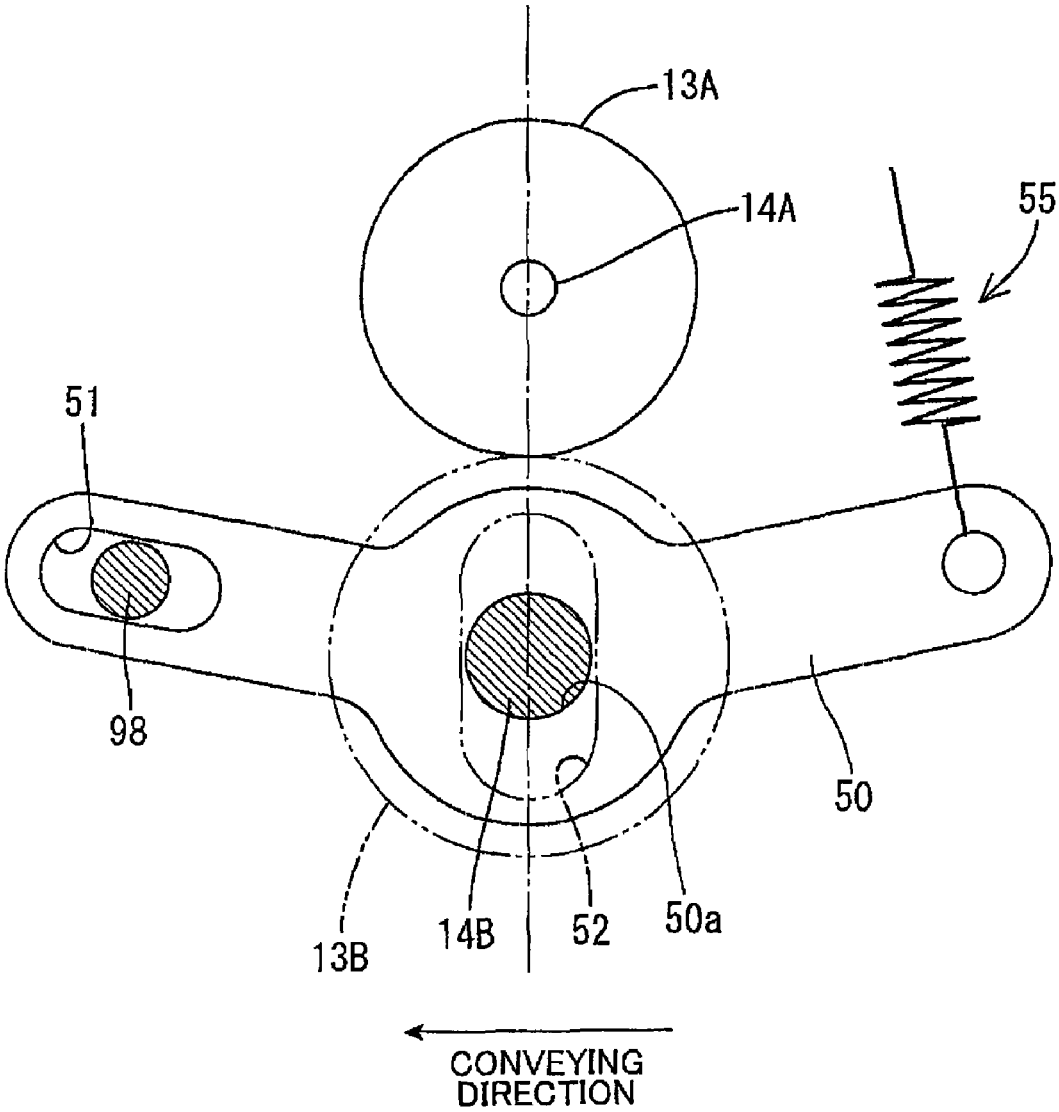
FIG. 14 is an explanatory diagram showing a configuration in which the conveying roller is movable relative to the paper dust collecting roller.

As shown in FIG. 14, the bearing member 50 is shaped substantially like a character V (with being bent at the center in the longitudinal direction and extending toward both ends thereof) to form a long thin plate in the sheet conveying direction. A circular hole 50*a* is formed at the substantially central position of the bearing member 50. The roller shaft 14B of the conveying roller 13B is rotatably supported by the circular hole 50*a*. An escape hole 51 is formed on the downstream end of the bearing member 50 in the conveying direction. The escape hole 51 accommodates a protruding part 98 having a circular cross section and protruding from the side wall 97A of the sheet feed unit 97. A spring 55 is connected to the upstream end of the bearing member 50 in the conveying direction. The conveying roller 13B is urged toward the paper dust collecting roller 13A by the spring 55.

The escape hole 51 is an elongated hole which is long in the front-to-rear direction (conveying direction). Thus, when the protruding part 98 is accommodated in the escape hole 51, a gap (clearance) is formed between the protruding part 98 and the inner edge of the escape hole 51.

A guide hole 52 is formed on the side wall 97A of the sheet feed unit 97. The guide hole 52 is an elongated hole which is long in the vertical direction (more specifically, the direction connecting between the axial center of the conveying roller 13B and the axial center of the paper dust collecting roller 13A). The roller shaft 14B of the conveying roller 13B is accommodated (received) in the guide hole 52 so as to be freely movable (swingable) along the longitudinal direction of the guide hole 52.

The roller shaft 14B of the conveying roller 13B is received in the guide hole 52, thereby allowing the conveying roller 13B to move in the vertical direction. The escape hole 51 is provided to enable linear movement (vertical movement) of the conveying roller 13B. That is, if the escape hole 51 is not provided and the bearing member 50 merely pivotally moves about the protruding part 98, the conveying roller 13B moves to draw a circular arc about the protruding part 98 and cannot move linearly (vertically).

Figure 11:
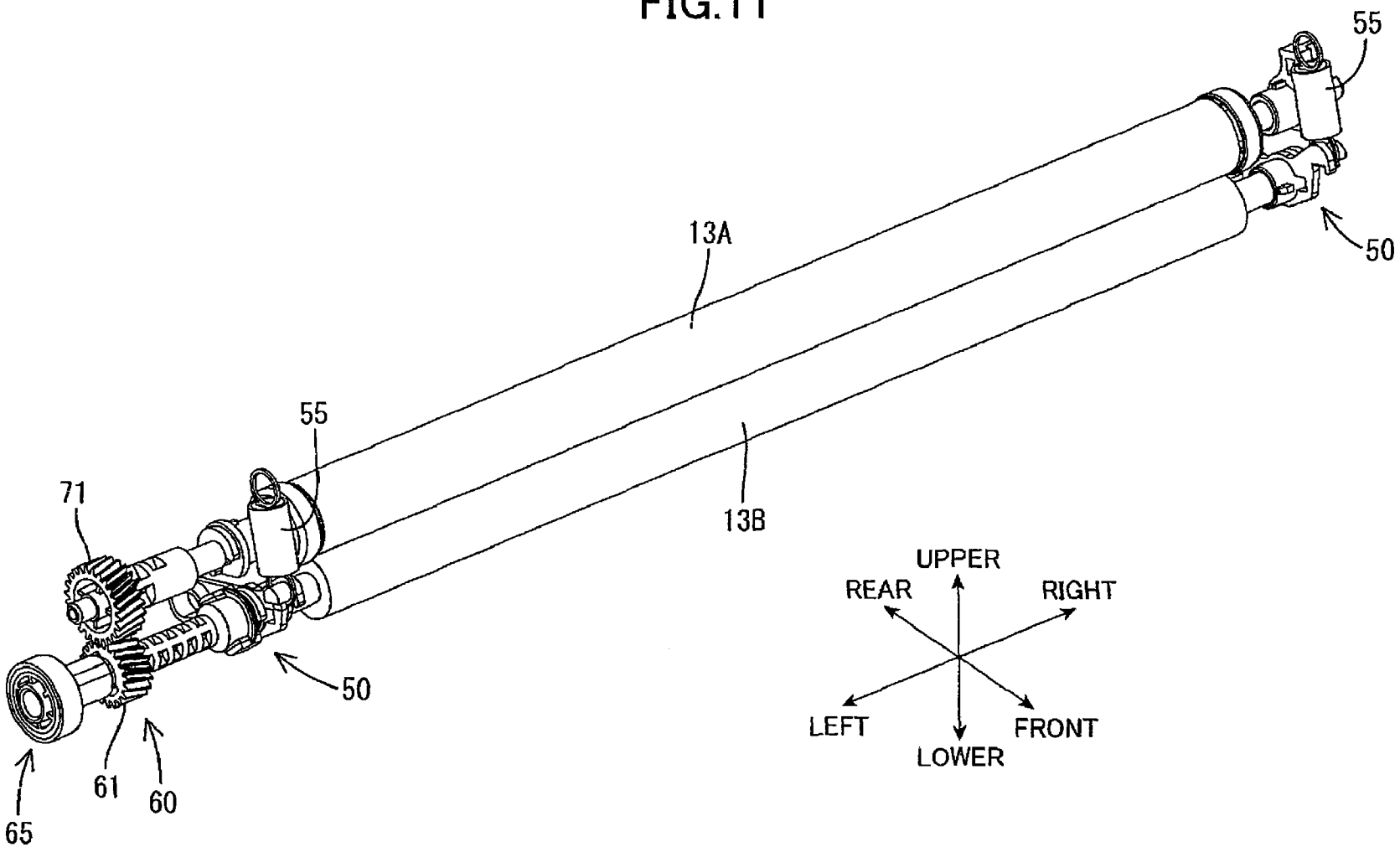
FIG. 11 is a perspective view showing a structure of transmitting a rotational force to the conveying roller and the paper dust collecting roller.

As shown in FIG. 11, the joint 60 for transmitting a rotational driving force transmitted from a connecting shaft 65 rotated by the rotational driving force of a motor (not shown) is connected to the roller shaft 14B of the conveying roller 13B.

The joint 60 is made of resin having high strength. When a sheet (especially thick paper or the like) is sandwichingly conveyed between the paper dust collecting roller 13A and the conveying roller 13B, the conveying roller 13B slightly moves in a direction perpendicular to the conveying direction (i.e., a direction away from the paper dust collecting roller 13A) by the thickness of the sheet. The joint 60 is configured so as to transmit the rotational driving force to the conveying roller 13B at a constant rotational speed, even when the conveying roller 13B moves in the direction perpendicular to the conveying direction. The drive gear 61 is provided on the outer circumference of a portion that connects the joint 60 to the connecting shaft 65. The drive gear 61 engages with the follow gear 71 of the paper dust collecting roller 13A, thereby rotating the paper dust collecting roller 13A.

Figure 12:
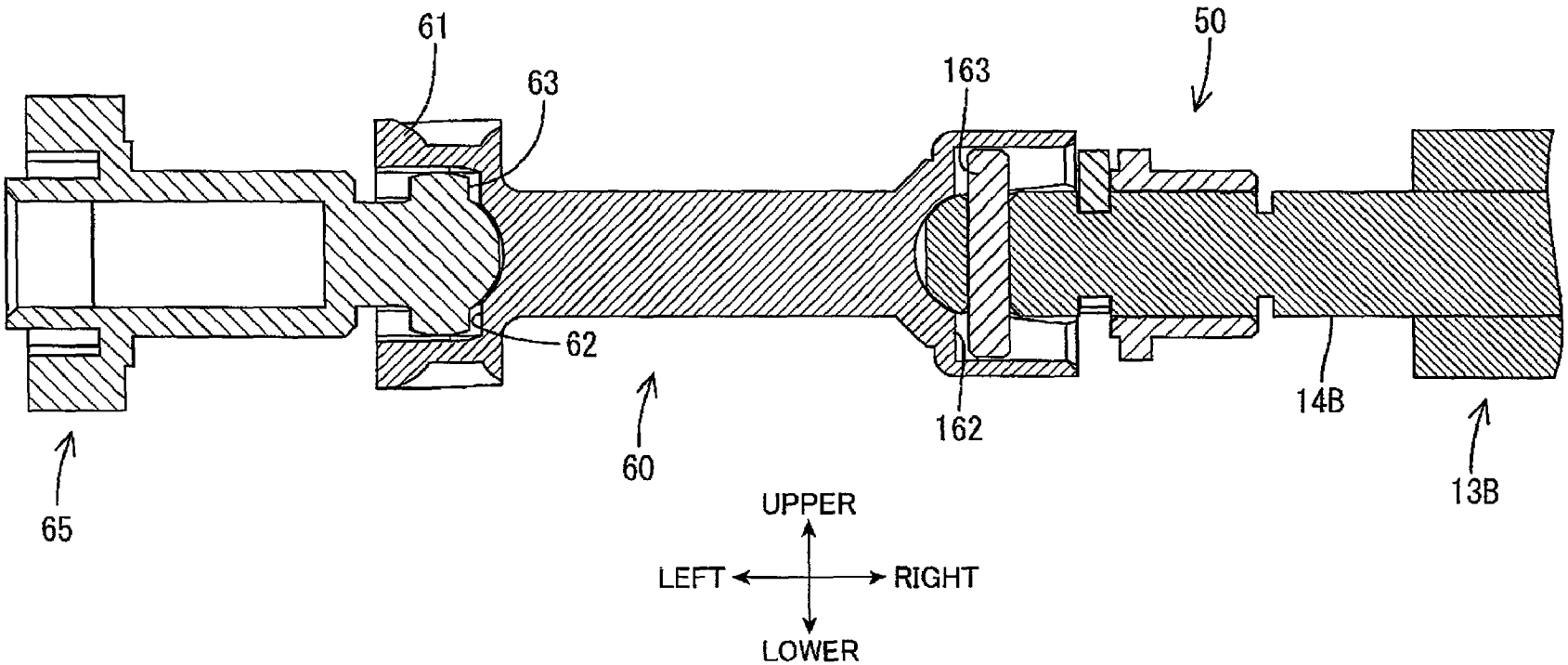
FIG. 12 is a cross-sectional view showing a state where a joint connects a connecting shaft to the conveying roller.
Figure 13:
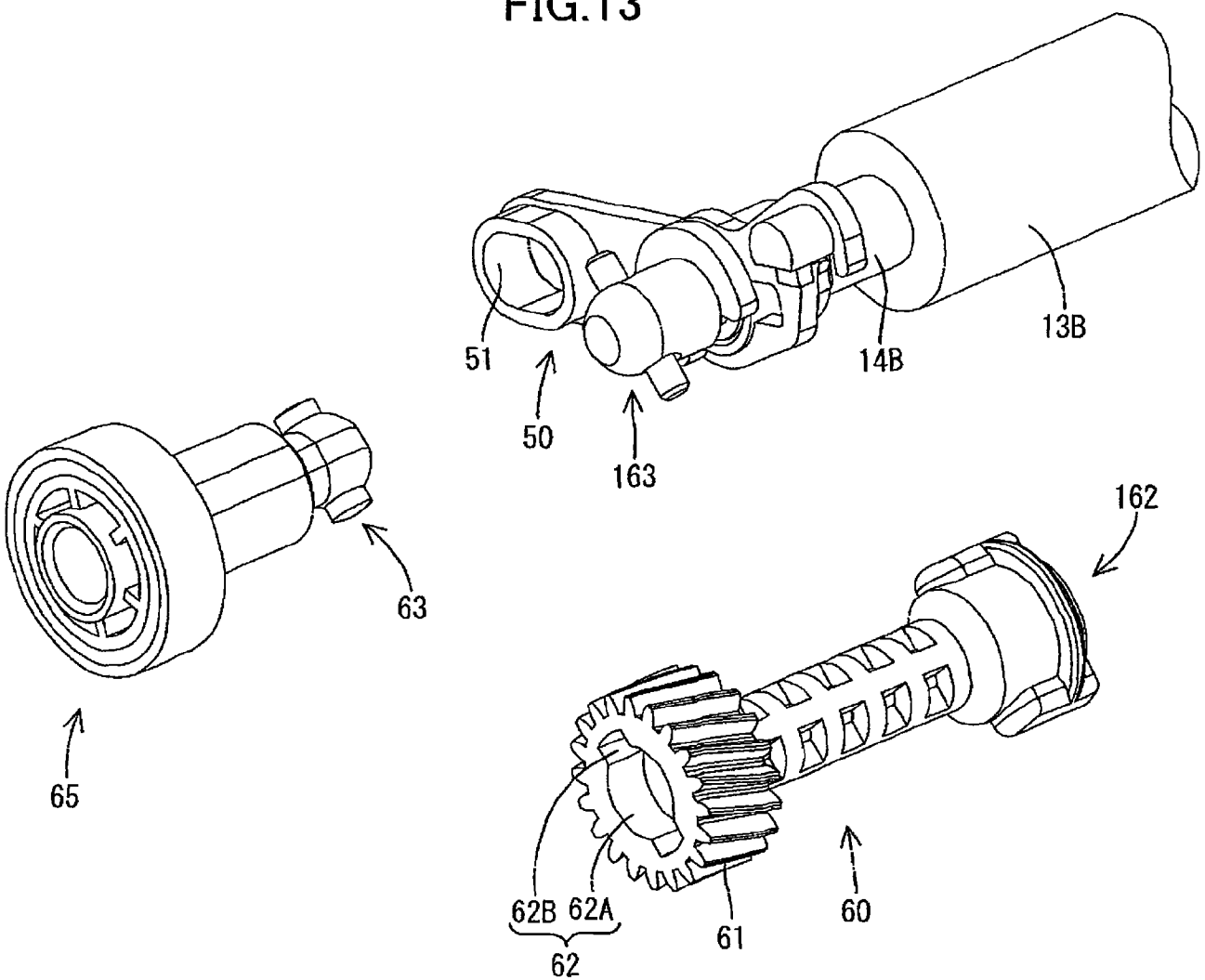
FIG. 13 is a perspective view showing a state where the joint is detached.

Both ends of the joint 60 are formed as a so-called universal joint. As shown in FIG. 12 and FIG. 13, an engaging concave part 62 is formed by forming notches 62B on the both ends of a circular concave part 62A. An engaging concave part 162 has a shape similar to the engaging concave part 62. An engaging convex part 63 is provided at the end of the connecting shaft 65 on the side of the joint 60. An engaging convex part 163 is provided at the end of the roller shaft 14B on the side of the joint 60. The engaging convex part 63 fits into the engaging concave part 62 with substantially no gap therebetween. Similarly, the engaging convex part 163 fits into the engaging concave part 162 with substantially no gap therebetween. With this configuration, during rotation, no slippage in the rotating direction occurs in the connecting portion between the joint 60 and the connecting shaft 65 and the connecting portion between the joint 60 and the roller shaft 14B.

As described above, when a sheet is sandwichingly conveyed between the paper dust collecting roller 13A and the conveying roller 13B, the conveying roller 13B slightly moves in the direction away from the paper dust collecting roller 13A by the thickness of the sheet. At this time, an angle between an axis of the roller shaft 14B and an axis of the joint 60 deviate slightly from 180 degrees. Thus, an angle between the axis of the joint 60 and an axis of the connecting shaft 65 also deviates slightly from 180 degrees. As a result, an engagement between the drive gear 61 and the follow gear 71 deviates slightly from its normal condition in which an axis of the drive gear 61 and an axis of the follow gear 71 are at an angle of 180 degrees. However, this deviation is so small and does not affect transmission of the rotational driving force from the drive gear 61 to the follow gear 71. Hence, the joint 60 is capable of transmitting rotation to the paper dust collecting roller 13A at a constant rotational speed.

<Configuration for Removing Paper Dusts Adhered to Sheet>

Figure 8:
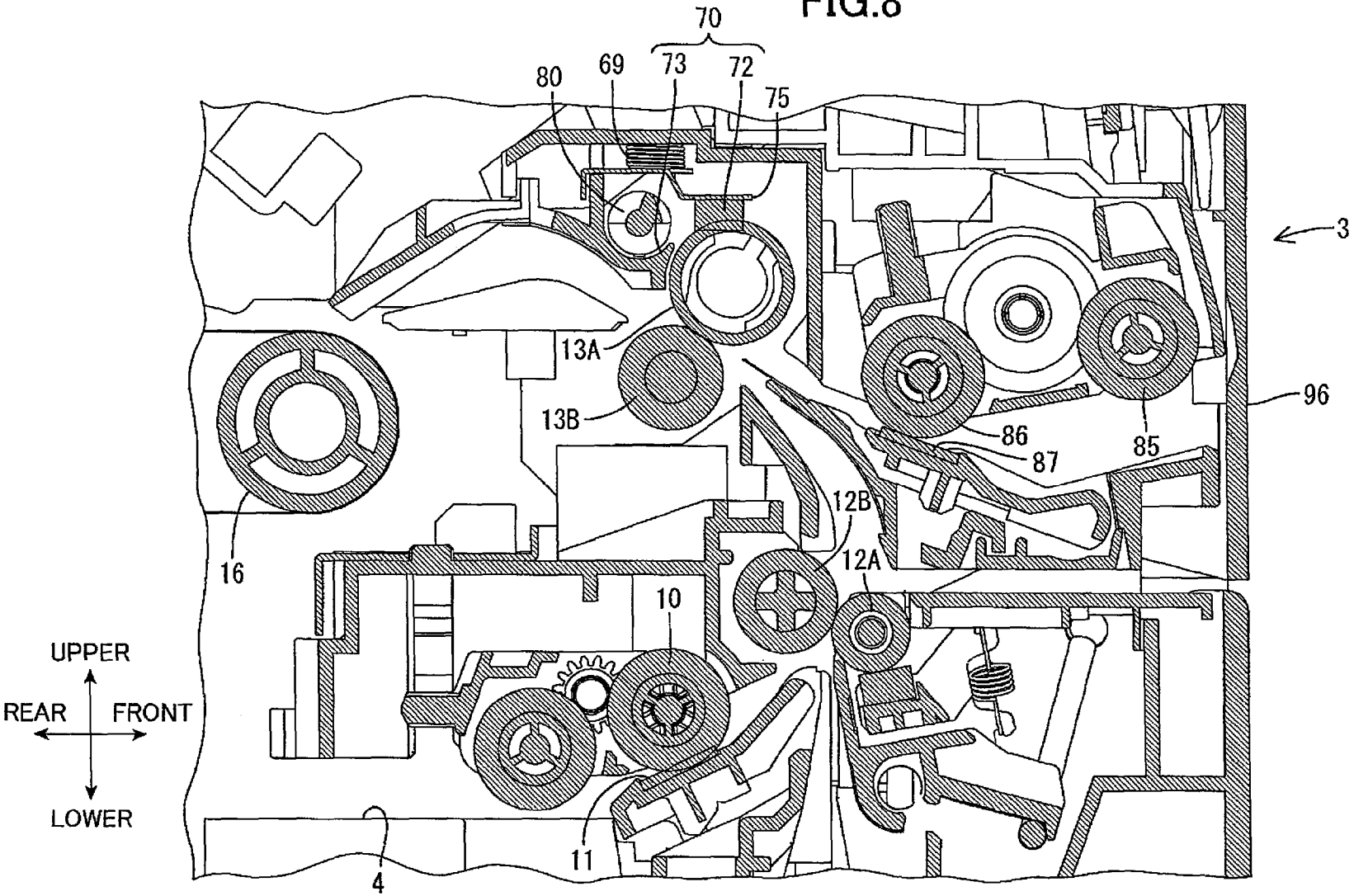
FIG. 8 is a partially enlarged side cross-sectional view of the laser printer.

As shown in FIG. 8, the surface of the paper dust collecting roller 13A is made of fluorocarbon resin which is easily charged. During rotation of the paper dust collecting roller 13A, static electricity is generated on the surface of the paper dust collecting roller 13A due to contact (friction) between the paper dust collecting roller 13A and a sponge member 72 described below. The paper dusts adhered to the conveyed sheet 4 are drawn by static electricity.

The paper dust removing part 70 has the sponge member 72 and a paper dust receiving part 73. The sponge member 72 scrapes off the paper dusts on the surface of the paper dust collecting roller 13A. The paper dust receiving part 73 receives the paper dusts scraped by the sponge member 72.

The sponge member 72 is a rectangular member made of urethane foam or the like. The sponge member 72 is fixed (fixedly attached) to a metal thin plate 75 swingably supported by an inner wall of the cover main body 96. The sponge member 72 is urged by an urging force of an urging member 69 formed of a compression coil spring through the metal thin plate 75 and contacts the surface of the paper dust collecting roller 13A.

With such configuration, when the paper dust collecting roller 13A rotates in the clockwise direction in FIG. 8, paper dusts are scraped from the surface of the paper dust collecting roller 13A by the sponge member 72 to get agglomerated and then, fall onto the paper dust receiving part 73.

The paper dust receiving part 73 is formed in the arc and concave shape over the whole width in the width direction of the sheet conveying path (left-to-right direction). Agglomerated paper dusts scraped by the sponge member 72 fall onto the paper dust receiving part 73.

As shown in FIGS. 3 and 8 through 10, the auger member 80 extends in the paper dust receiving part 73 in the left-to-right direction. The auger member 80 conveys paper dusts on the paper dust receiving part 73 to the both widthwise ends of the main casing 2 where paper dust passage holes 81 described later are provided.

The auger member 80 has a shaft member 82 and a spiral part 83 spirally formed around the shaft member 82 in an integral manner. An auger driving gear (not shown) to which a driving force is input from a motor (not shown) is provided at one end of the shaft member 82.

The spiral part 83 changes its rotating direction substantially at the center of the shaft member 82. Hence, the conveying direction of paper dusts changes at the center of the auger member 80. That is, paper dusts are conveyed to the closer side wall 97A by rotation of the auger member 80 in a predetermined direction.

The paper dust passage holes 81 through which paper dusts conveyed by the auger member 80 pass (fall) are formed at end parts 73A of the paper dust receiving part 73 located at both ends to which the paper dusts are conveyed by the auger member 80.

Each paper dust passage hole 81 is a tube having an inner diameter which allows passage of paper dusts. The paper dust passage holes 81 are provided along the vertical direction and in continuation with the paper dust receiving part 73. The paper dust passage holes 81 communicates with the paper dust storing chamber 90 described later.

Figure 9:
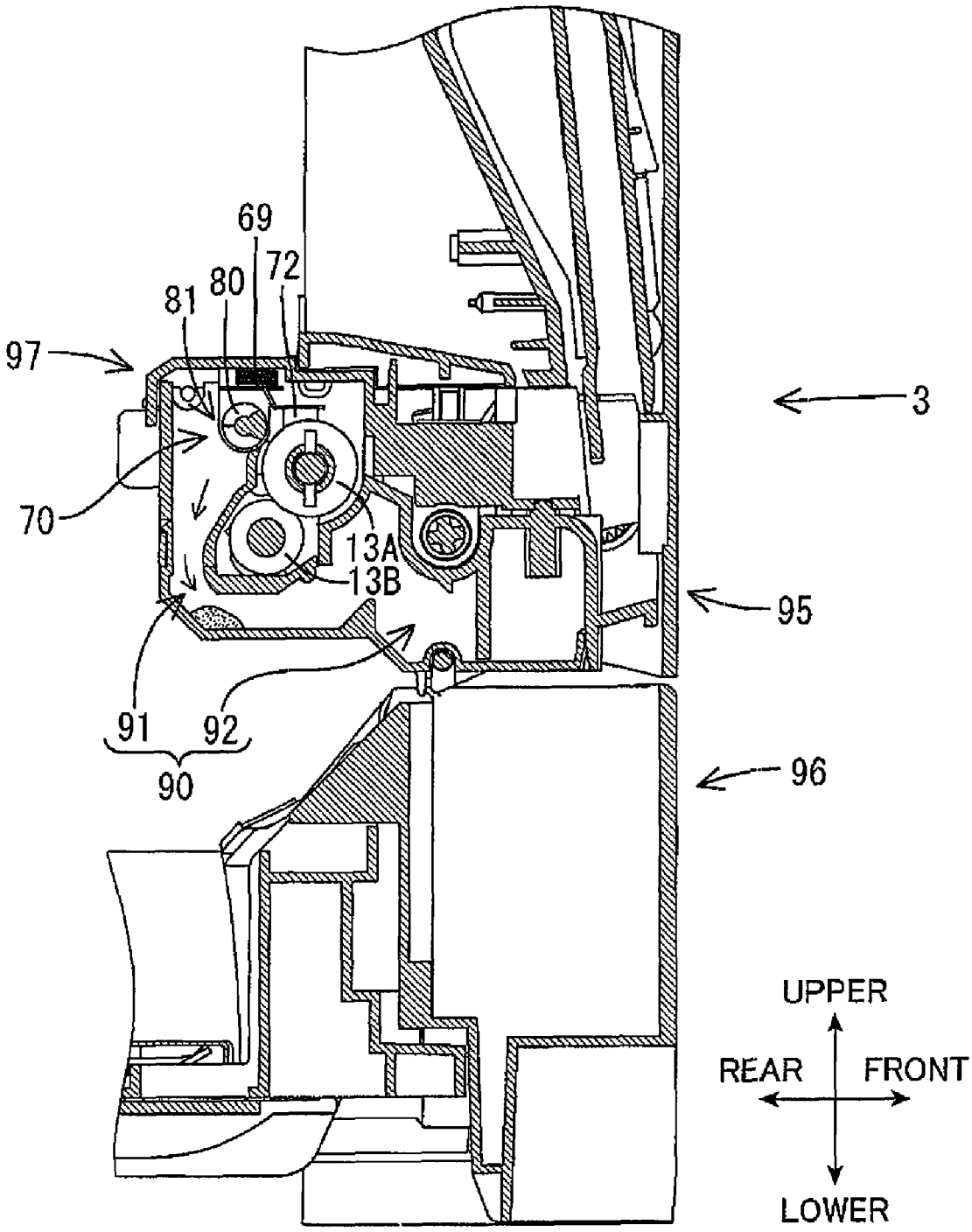
FIG. 9 is an enlarged cross-sectional view of a sheet feed unit and the surrounding area, taken along a line IX-IX in FIG. 3.
Figure 10:
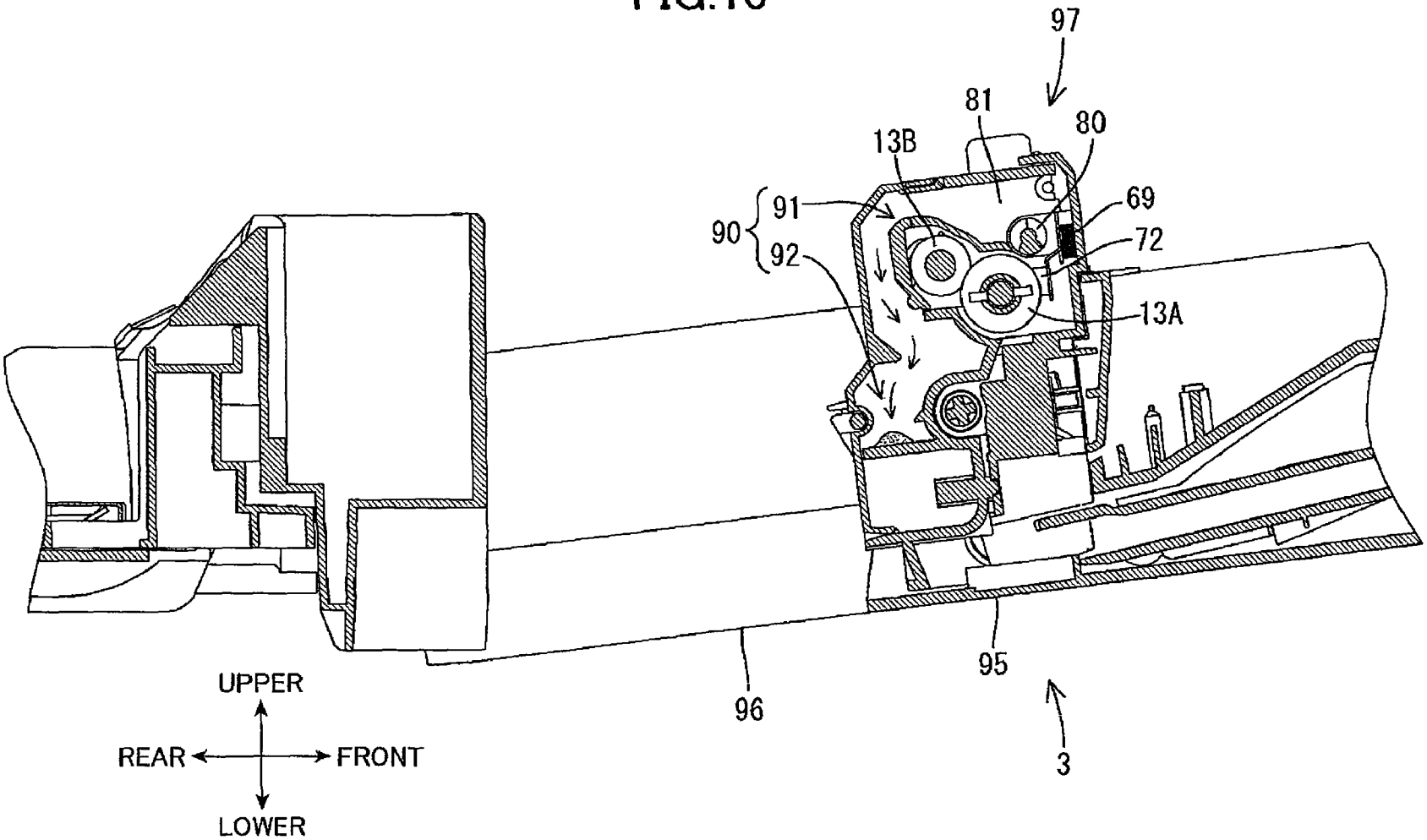
FIG. 10 is a side cross-sectional view of the front cover in FIG. 9 in an open position.

As shown in FIGS. 3, 9 and 10, the paper dust storing chamber 90 which stores paper dusts passing (falling) through the paper dust passage holes 81 therein is formed in the sheet feed unit 97.

As shown in FIG. 3, the paper dust storing chamber 90 serves to store paper dusts therein. The paper dust storing chamber 90 is provided over the whole width of the sheet conveying path. The both ends of the paper dust storing chamber 90 in the width direction communicate with the paper dust passage holes 81.

As shown in FIG. 9, the paper dust storing chamber 90 has a primary storing part 91 which stores the paper dusts conveyed by the auger member 80 and a secondary storing part 92 which communicates with the primary storing part 91.

The primary storing part 91 is provided at the rear end in the sheet feed unit 97 and below the paper dust passage holes 81 (below the both ends of the conveying path of the auger member 80) in the closed state of the front cover 3.

The secondary storing part 92 is provided at the lower end in the sheet feed unit 97 at the front of the primary storing part 91. More specifically, the secondary storing part 92 is provided at the front of an area where paper dusts are firstly stored in the primary storing part 91 (the area shown in FIG. 9 where paper dusts are accumulated) to the substantially central part in the sheet feed unit 97 in the front-to-rear direction.

With such configuration, as shown in FIG. 10, when the front cover 3 is opened to an open position (the position at which the front cover 3 is opened from the closed state by 90 degrees or an angle slightly smaller than 90 degrees), the secondary storing part 92 is located below the left end of the primary storing part 91 in FIG. 10 (the lower end in FIG. 9). Consequently, paper dusts stored in the primary storing part 91 move (fall) and then, the paper dusts are stored at the lower end of the secondary storing part 92 in FIG. 10.

Note that a manual feeding port (not shown) is provided at the front cover 3. Sheets of multiple sizes can be fed from the manual feeding port. In more detail, as shown in FIG. 8, a manual feeding mechanism has a multipurpose conveying roller 85, a multipurpose sheet feeding roller 86, and a multipurpose separating pad 87 in confrontation with the multipurpose sheet feeding roller 86. Sheets fed from the manual feeding port are guided to the multipurpose sheet feeding roller 86 by the multipurpose conveying roller 85. The sheets are held between the multipurpose sheet feeding roller 86 and the multipurpose separating pad 87 due to rotation of the multipurpose sheet feeding roller 85, and through cooperation of these elements, the sheets are separated from each other and fed one sheet at a time. The fed sheet is conveyed to the paper dust collecting roller 13A and the conveying roller 13B.

3. Effects of the Illustrative Aspects (1) If a conveying roller is fixed at a position in the main casing and a paper dust collecting roller is movably supported, it is desired that a sponge member (paper dust removing member) is also movably supported. However, if the sponge member is movably supported, a structure for moving the sponge member is required, resulting in more complicated configuration.

In the illustrative aspects, the paper dust collecting roller 13A is rotatably supported at the fixed position and the conveying roller 13B is movably supported. Consequently, there is no need to provide a mechanism for moving the paper dust removing part 70 (paper dust removing unit) following movement of the paper dust collecting roller. Therefore, the configuration is simplified in comparison with the configuration of moving the paper dust collecting roller.

(2) If the rotational driving force is applied to a conveying roller from the axial direction of the conveying roller, position of the conveying roller relative to a paper dust collecting roller moves and thus, there is a possibility that the rotational driving force is not transmitted properly.

In the illustrative aspects, the conveying roller 13B is connected to the joint 60 which can transmit the rotational driving force from the conveying roller 13B by following movement of the conveying roller 13B relative to the paper dust collecting roller 13A. Thus, even when the conveying roller 13B moves, the rotational driving force can be properly transmitted to the paper dust collecting roller 13A through the joint 60. Therefore, with rotation of the conveying roller 13B, the sheet 4 can be properly conveyed.

(3) Paper dusts which are conveyed by an auger member (paper dust conveying unit) and stored in a paper dust storing chamber (paper dust storing unit) tend to concentrate at a certain place.

In the illustrative aspects, the paper dust storing chamber 90 is provided at the front cover 3 of the main casing 2. Thus, even when paper dusts conveyed by the auger member 80 concentrate at a certain place, the paper dusts can be dispersed due to vibration at opening/closing of the front cover 3. Consequently, it is possible to prevent paper dusts from concentrating at the certain place in the paper dust storing chamber 90, thereby ensuring storage space for paper dusts.

(4) If a paper dust storing chamber (paper dust storing unit) is provided at the front cover 3, and a paper dust collecting roller, a paper dust removing part (paper dust removing unit), and an auger member (paper dust conveying unit) are provided at regions other than the front cover 3, it needs to further provide a mechanism for separating a paper dust storing chamber from a paper dust collecting roller, a paper dust removing part, and an auger member which are provided at the regions other than the front cover 3 as well as a seal mechanism for preventing leakage of paper dusts for each separated part.

In the illustrative aspects, the configuration in which paper dusts are removed and then stored is provided at the front cover 3. The mechanism from collection to storage of paper dusts can be formed as an integral unit and the seal mechanism is not required. For this reason, the configuration can be simplified.

(5) If the paper dust storing unit is provided above the conveying path of the sheet 4 (recording medium), the paper dust storing unit often needs to be provided in a limited small space.

In the illustrative aspects, the auger member 80 (paper dust conveying unit) conveys the paper dusts removed by the paper dust removing part 70 (paper dust removing unit) to the outside of the sheet conveying path in the width direction of the sheet conveying path. The paper dusts conveyed to the outside of the sheet conveying path are conveyed downward in the vertical direction and stored in the paper dust storing chamber 90 (paper dust storing unit). Thus, the paper dust storing chamber 90 (paper dust storing unit) can be provided in a relatively large space.

(6) In the illustrative aspects, the paper dust passage holes 81 through which paper dusts conveyed to the outside of the sheet conveying path by the auger member 80 (paper dust conveying unit) pass are provided, and the paper dusts passing through the paper dust passage holes 81 are stored in the paper dust storing chamber 90 (paper dust storing unit). Thus, paper dusts conveyed by the auger member 80 can be prevented from scattering to the outside before the paper dusts are stored in the paper dust storing chamber 90.

(7) The paper dust storing chamber 90 (paper dust storing unit) includes the primary storing part 91 which stores paper dusts conveyed by the auger member 80 (paper dust conveying unit) therein and the secondary storing part 92 which communicates with the primary storing part 91 and stores paper dusts stored in the primary storing part 91 when the front cover 3 is opened. That is, the paper dusts stored in the primary storing part 91 are then stored in the secondary storing part 92 at opening of the front cover 3. Consequently, the paper dusts stored in the paper dust storing chamber 90 can be prevented from concentrating at a certain place.

(8) The front cover 3 is opened or closed by pivoting about the pivoting shaft. Hence, without complicated mechanism, paper dusts stored in the primary storing part 91 can be moved to the secondary storing part 92 by opening the front cover 3.

(9) The front cover 3 is kept open at a predetermined open position. At the predetermined open position, the secondary storing part 92 is located below the primary storing part 91. Thus, when the front cover 3 is located at the open position, paper dusts can be easily moved from the primary storing part 91 to the secondary storing part 92.

While the invention has been described in detail with reference to the above aspects thereof, it would be apparent to those skilled in the art that various changes and modifications may be made therein without departing from the spirit of the invention.

(1) In the above-described illustrative aspects, the spring is used as an urging means for urging the conveying roller 13B toward the paper dust collecting roller 13A. However, the urging means is not limited to the spring and for example, an elastically deformable member such as rubber may be adopted.

(2) In the above-described illustrative aspects, the front cover 3 is opened or closed by pivoting about the pivoting shaft 3A. However, for example, the front cover 3 may be opened or closed by being pulled out. In this manner, accumulated paper dusts can be dispersed by vibration at pulling-out of the front cover. Further, paper dusts may be dispersed by moving the paper dusts from the primary storing part to the secondary storing part due to vibration at pulling-out of the front cover. Alternatively, a mechanism for moving paper dusts from the primary storing part to the secondary storing part may be separately provided.

(3) In the above-described illustrative aspects, a rotational force is transmitted by the joint 60 following movement of the conveying roller 13B. However, the configuration of transmitting the rotational force is not limited to this. For example, the rotational force may be transmitted by using an Oldham coupling, a Schmitt coupling or the like.

What is claimed is:

1. An image forming apparatus comprising:

a main casing formed with an opening;

a cover that is configured to selectively open and close the opening;

a paper-dust collecting unit disposed at a position along a conveying path of a recording medium, the paper-dust collecting unit being configured to collect paper dusts adhering to the recording medium;

a paper-dust removing member that removes the paper dusts collected by the paper-dust collecting unit;

a paper-dust conveying unit that conveys the paper dusts removed by the paper-dust removing member; and a paper-dust storing unit that stores the paper dusts conveyed by the paper-dust conveying unit, wherein:

the paper-dust collecting unit comprises:

a paper-dust collecting roller that is rotatably supported at a fixed position in the main casing;

a conveying roller that is supported at a position in confrontation with the paper-dust collecting roller, the conveying roller being configured to move relative to the paper-dust collecting roller and configured to convey the recording medium along the conveying path; and an urging member that urges the conveying roller toward the paper-dust collecting roller; and the paper-dust collecting unit, the paper-dust removing member, the paper-dust conveying unit, and the paper-dust storing unit are provided at the cover.

2. The image forming apparatus according to claim 1, wherein the conveying roller includes a roller shaft to which a rotational driving force is supplied, further comprising a joint that is coupled to the conveying roller and that is configured to follow movement of the conveying roller relative to the paper-dust collecting roller, thereby transmitting the rotational driving force to the conveying roller.

3. The image forming apparatus according to claim 2, further comprising a bearing member that is configured to move relative to the paper-dust collecting roller and that rotatably supports the roller shaft.

4. The image forming apparatus according to claim 3, wherein a circular hole is formed in the bearing member, the roller shaft being rotatably supported by the circular hole;

wherein the main casing is formed with a guide hole, the guide hole being an elongated hole which is long in a direction connecting between an axial center of the conveying roller and an axial center of the paper-dust collecting roller; and wherein the roller shaft is accommodated in the guide hole so as to be freely movable along a longitudinal direction of the guide hole.

5. The image forming apparatus according to claim 3, further comprising a protruding part that protrudes from the main casing, wherein the bearing member is formed with an escape hole that accommodates the protruding part and that has an inner edge, the escape hole being an elongated hole which is long in a conveying direction for conveying the recording medium, allowing a gap to be formed between the protruding part and the inner edge when the protruding part is accommodated in the escape hole.

6. The image forming apparatus according to claim 2, further comprising a connecting shaft configured to receive the rotational driving force, wherein the joint has one axial end connected to the connecting shaft and formed as a universal joint, and another axial end connected to the roller shaft and formed as a universal joint.

7. The image forming apparatus according to claim 6, wherein each of the one axial end and the another axial end has an engaging concave part that is formed by forming notches on both ends of a circular concave part; and wherein each of the connecting shaft and the roller shaft has an engaging convex part that engages a corresponding one of the engaging concave parts.

8. The image forming apparatus according to claim 1, further comprising:

a process cartridge disposed in the main casing and configured to form images on the recording medium; and a conveying belt disposed below the process cartridge and configured to convey the recording medium, wherein the conveying path leads to the conveying belt.

* * * * *